United States Patent [19]

Ono et al.

[11] 4,339,735

[45] Jul. 13, 1982

[54] ELECTROMAGNETIC RELAY

[75] Inventors: Kenji Ono, Yawata; Kazuhiro Nobutoki, Kadama, both of Japan; Hans Sauer, Fichtenstrasse 5, Deisenhofen, Fed. Rep. of Germany, D-8024

[73] Assignees: Matsushita Electric Works, Ltd., Osaka, Japan; Hans Sauer, Deisenhofen, Fed. Rep. of Germany

[21] Appl. No.: 167,049

[22] Filed: Jul. 9, 1980

[30] Foreign Application Priority Data

Jul. 18, 1979 [JP] Japan ..... 54-91836

[51] Int. Cl.[3] ..... H01H 50/28; H01H 50/58

[52] U.S. Cl. ..... 335/119; 335/125; 335/203; 335/276; 335/232

[58] Field of Search ..... 335/125, 119, 120, 202, 335/203, 229, 232, 265, 270, 276, 80, 81, 82, 79

[56] References Cited

U.S. PATENT DOCUMENTS 2,960,583 11/1960 Fisher et al. ..... 335/80 X 3,499,463 3/1970 Trott et al. ..... 335/276

3,993,971 11/1976 Ono et al. ..... 335/78X 4,272,745 6/1981 Tanaka et al. ..... 355/203 X

FOREIGN PATENT DOCUMENTS 2454967 12/1976 Fed. Rep. of Germany .

*Primary Examiner*—L. T. Hix

*Assistant Examiner*—Stafford D. Schreyer

*Attorney, Agent, or Firm*—Jeffery, Schwaab, Mack, Blumenthal & Koch Schwartz

[57] ABSTRACT

In an electromagnetic relay, an armature block serving to actuate contact springs includes a pair of armatures and a permanent magnet disposed therebetween to magnetize the armatures to opposite polarities. Pole ends of a yoke carrying the excitation flux created by the relay coil extend between free ends of the armatures. The armature block is suspended by means of a resilient arm integrally formed with the block at one side thereof and having its outer end fixed to a bearing portion, so that a rocking motion of the armature block is achieved by a flexing motion of the resilient arm.

7 Claims, 19 Drawing Figures

FIG. 11
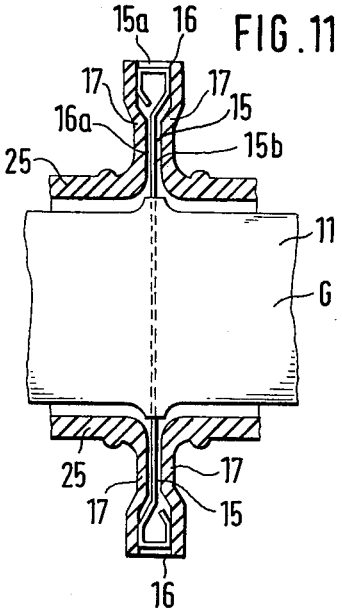
FIG. 12
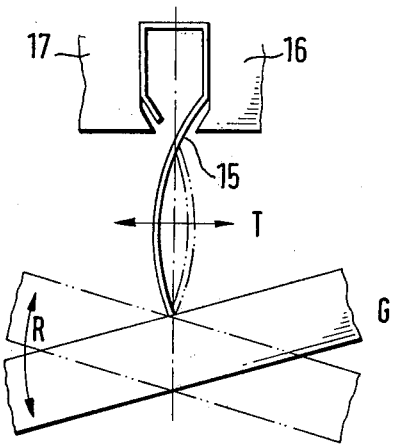
FIG. 13A
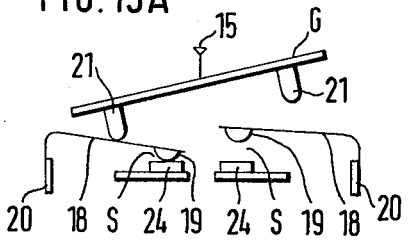
FIG. 14A
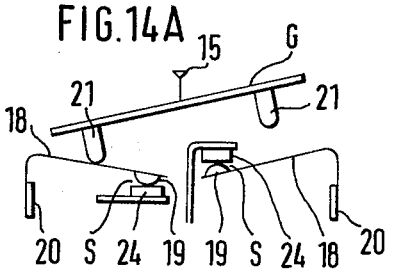
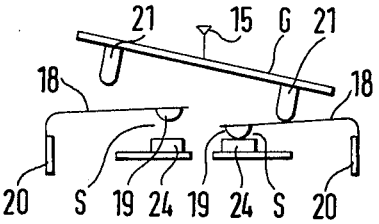
FIG. 13B
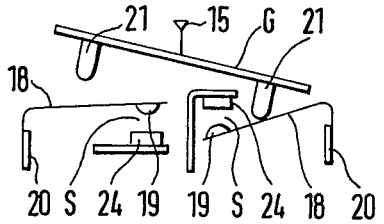
FIG. 14B FIG. 17
PRIOR ART
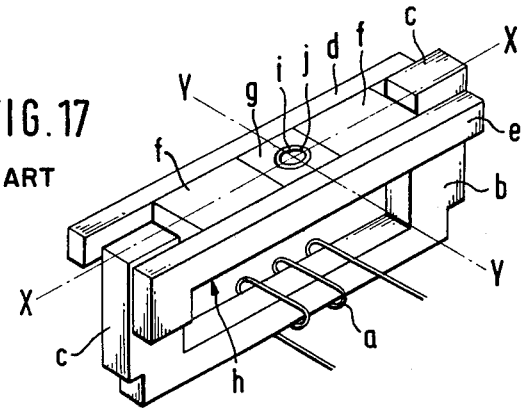
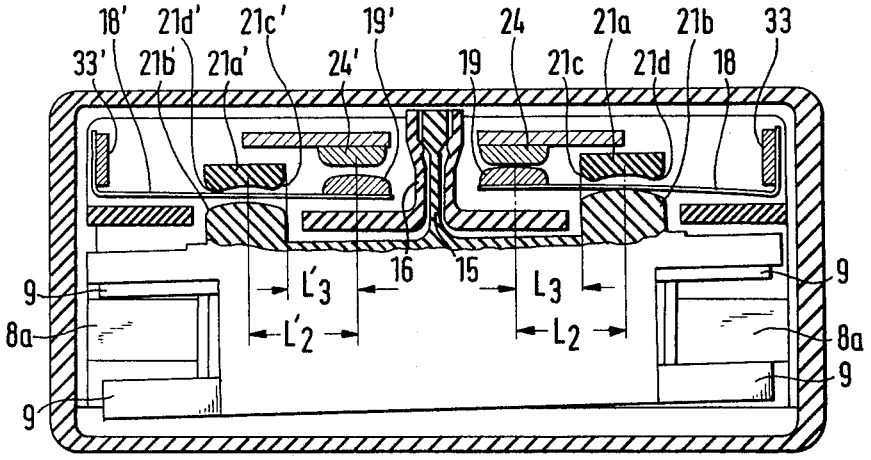
FIG. 16
FIG. 15
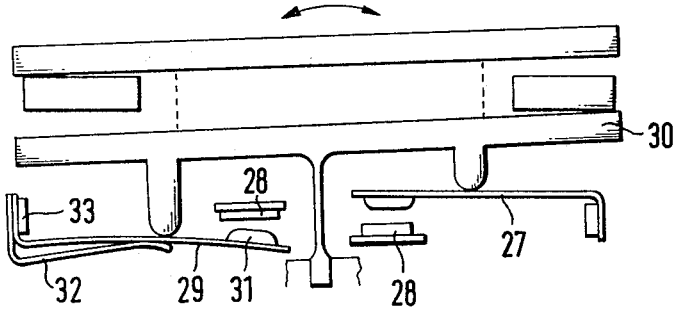

ELECTROMAGNETIC RELAY

FIELD OF THE INVENTION

This invention relates to an electromagnetic relay of the type having contact points adapted to be opened and closed in response to a rocking motion of an armature block driven by a coil current.

BACKGROUND OF THE INVENTION

A prior art electromagnetic relay of this type generally has the construction depicted in FIG. 17. Such a relay includes an armature block h comprising a pair of armatures d and e disposed in parallel relationship before and behind projecting ends of a yoke b carrying a coil winding a and a permanent magnet f interposed between said armatures d and e, said armature block being pivotally supported about the center of said armatures d and e by means of a round shaft i and a corresponding hole j.

The construction of the relay in which the rotation or rocking motion of said armature block is effected by means of such a shaft-and-hole pivot has the following disadvantages.

(1) The round shaft i must be exactly located at the point of intersection of the centerline X—X of said armatures d and e with the centerline Y—Y of said yoke b. The rationale of such a construction is that because the armatures d and e are to abut against the projecting ends of the yoke b, if the pivot shaft i is displaced out of said point of intersection, the contact areas of said projecting ends deviate from the specified setting to create a gap at one end whilst adequate abutment is established at the other end, the gap resulting in unstable abutment, and, hence, in beats and poor electrical contact. It requires a high degree of engineering skill to establish a perfect registry of the round shaft with said point of intersection.

(2) There must of course be a certain clearance including a fitting margin between the round shaft i and hole j, but because of this clearance, one of said projecting ends may not be contacted if the other end is successfully brought into abutment, thus resulting in unstable contact actions. Furthermore, because the dynamics of this system is such that the forces of abutment (the forces of attraction) at both ends are concentrated on one side of the round pivot shaft and the combined force is utilized as the contact pressing force, an inadequate force of abutment at one end results in a reduced contact-pressing force which is less than the set value and ultimately causes an inadequacy of power of the electromagnetic relay.

(3) In connection with (2) above, if the clearance between the round pivot shaft and the hole is decreased too much, the frictional resistance is increased so much as to detract from the force of pivotal rotation.

Furthermore, the armature block construction of such prior art electromagnetic relay is generally such that the permanent magnet is disposed centrally in an integral molding of segments which serve as said pair of armatures. However, after the molding operation, there arises a dimensional variation between the armatures due to the influences of heat, etc., thus altering the stroke of the armatures relative to the yoke.

Moreover, the general card construction of such prior art electromagnetic relay is that the card portion thereof which is adapted to compress the contact spring is integrally formed with the armature block. This construction is adopted because, in the ordinary electromagnetic relay of this type, a high contact pressure and a great contact wiping action at contact closure are necessary to ensure a high switching capacity and a high resistance to fusion and, hence, the so-called flexure contact drive system of compressing the contact springs with cards is employed. However, with such cards, if one of the contacts has been fused, the armature block may still rotate, in disregard of this trouble, to close the other contact as well, thus causing a circuit trouble, unless certain additional measures are taken.

There is also known an electromagnetic relay of the type wherein one of the contacts is comprised of a flexure contact with the other contact being a lift-off contact. However, there is the problem of imbalance between the spring loads at contact closure, which leads to a poor agreement of spring load with the force of attraction of the electromagnetic relay. Thus, with such a construction, it has been difficult to ensure a sufficiently high sensitivity.

DETAILED DESCRIPTION OF THE INVENTION

It is a primary object of this invention to provide an electromagnetic relay which is simple in construction and easy to manufacture and, yet, which is free from variations in the armature gap and in the gap between the yoke and armatures and, hence, ensures stable and positive switching actions.

It is another object of this invention to provide an electromagnetic relay which is excellent in resistance to fusion, consistency of mechanical load with the force of attraction, and dielectric strength.

In accordance with this invention, an insulation frame supporting a pair of armatures and a permanent magnet has, as centrally disposed with respect thereto and integrally formed therewith, a resilient arm capable of flexing in a direction perpendicular to the rotational direction of the armatures, said resilient arm being fixedly supported by a bearing portion of a relay base. This arrangement disposes of the round shaft and hole from the rotatable block including the armatures and, hence, eliminates the need for paying more than usual care in attaining adequate accuracy about the axis of rotation. Moreover, the armatures, permanent magnet and insulation frame are integrally formed to further help accomplish the above-mentioned objects.

Moreover, in accordance with this invention, one of the armatures, the cards and the resilient arm for rotatably supporting the armatures are integrally formed to provide an accurate control of the armature gap and, hence, to further help accomplish the above-mentioned objects.

The above mentioned objects are accomplished also by the provision of crank portions as extending from the surfaces of two cards which are adapted to compress the contact springs in such a manner that the inner surface of each of said crank portions confronts the contact spring compression surface through a gap therebetween so as to ensure a forced release of the contact.

Further, in accordance with this invention, one of said pair of contacts is borne by a lift-off contact spring provided with an auxiliary spring which is adapted to come into abutment against a stationary member immediately before the release to augment the contact spring force so as to attain a balance in spring load between said spring and the counterpart flexure spring for an improved agreement with the force of attraction, thus accomplishing the above-mentioned objects.

This invention will hereinafter be described in detail, reference being had to the accompanying drawings which depict preferred embodiments of this invention.

BRIEF DESCRIPTION OF DRAWINGS

FIG. 11 is a sectional view of another embodiment;

FIG. 12 is an enlarged view showing the mode of operation;

FIG. 13*a* is a diagramatic view illustrating switching operation of a relay having one normally open contact and one normally closed contact with the relay in the rest position;

FIG. 13*b* is a diagramatic view illustrating the relay of FIG. 13*a* in the active position;

FIG. 14*a* is a diagramatic view illustrating a relay having two normally open contacts with the relay in the rest position;

FIG. 14*b* is a diagramatic view illustrating the relay of FIG. 14*a* in the active position;

FIG. 15 is a schematic view showing a different embodiment of this invention;

FIG. 16 is an embodiment of the invention with a flexure lift-off system; and FIG. 17 is a view showing the prior art electromagnetic relay referred to above.

DETAILED DESCRIPTION OF THE INVENTION

Figure 1:
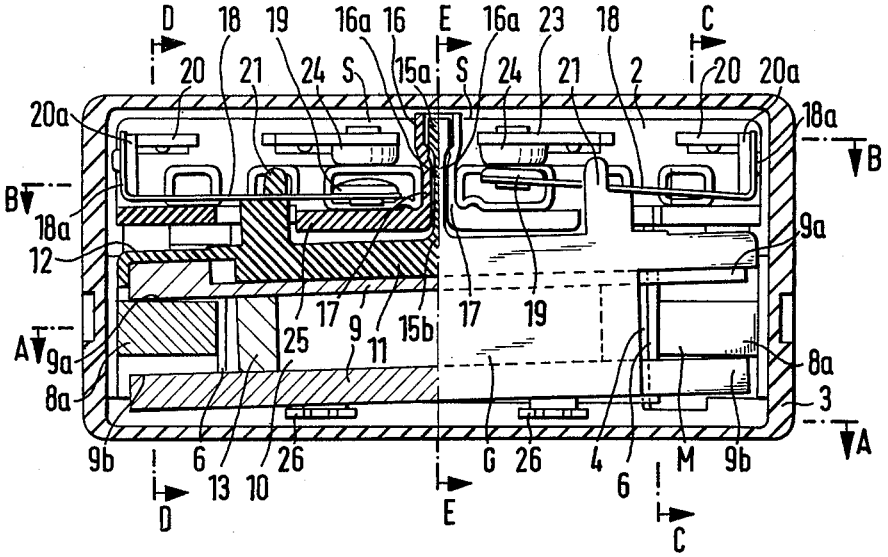
FIG. 1 is a sectional front view.
Figure 2:
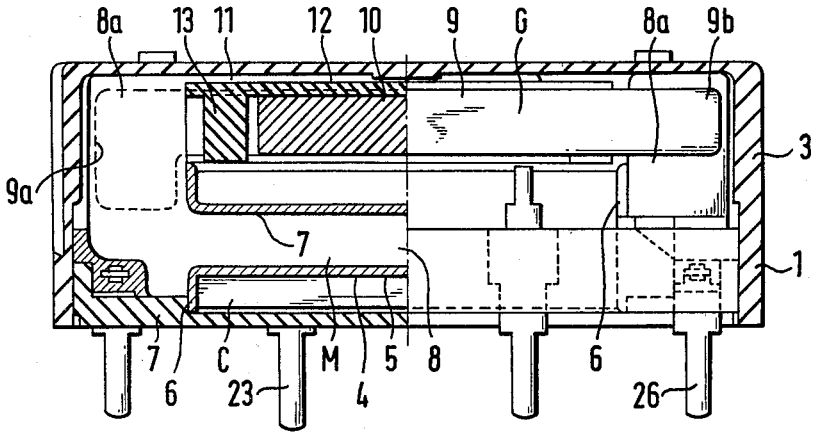
FIGS. 2 and 3 are longitudinal sections taken along the lines A—A and B—B of FIG. 1, respectively.
Figure 3:
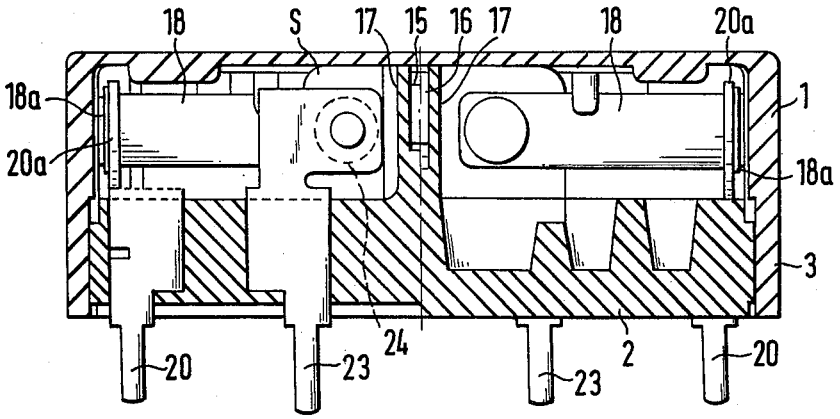
Figure 4:
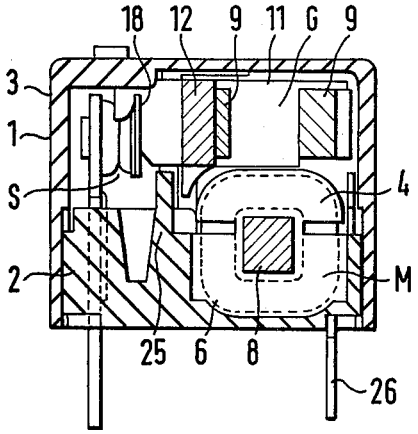
FIGS. 4 to 6 are cross-sectional views taken along the lines C—C, D—D and E—E of FIG. 1, respectively.
Figure 5:
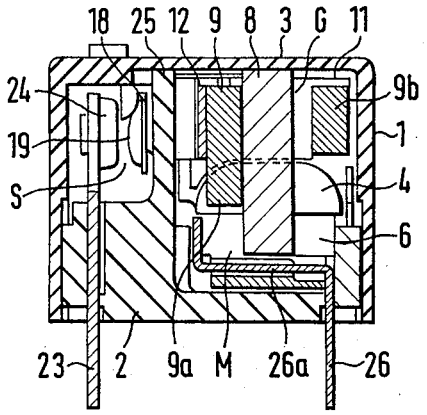
Figure 6:
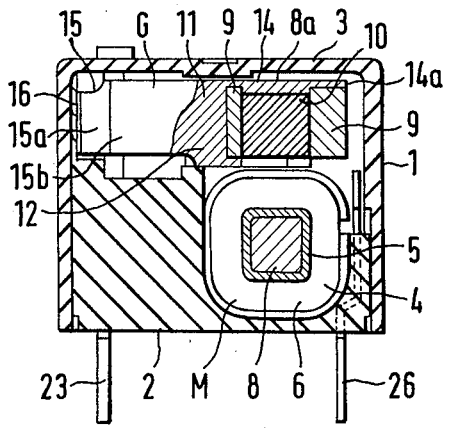
Figure 7:
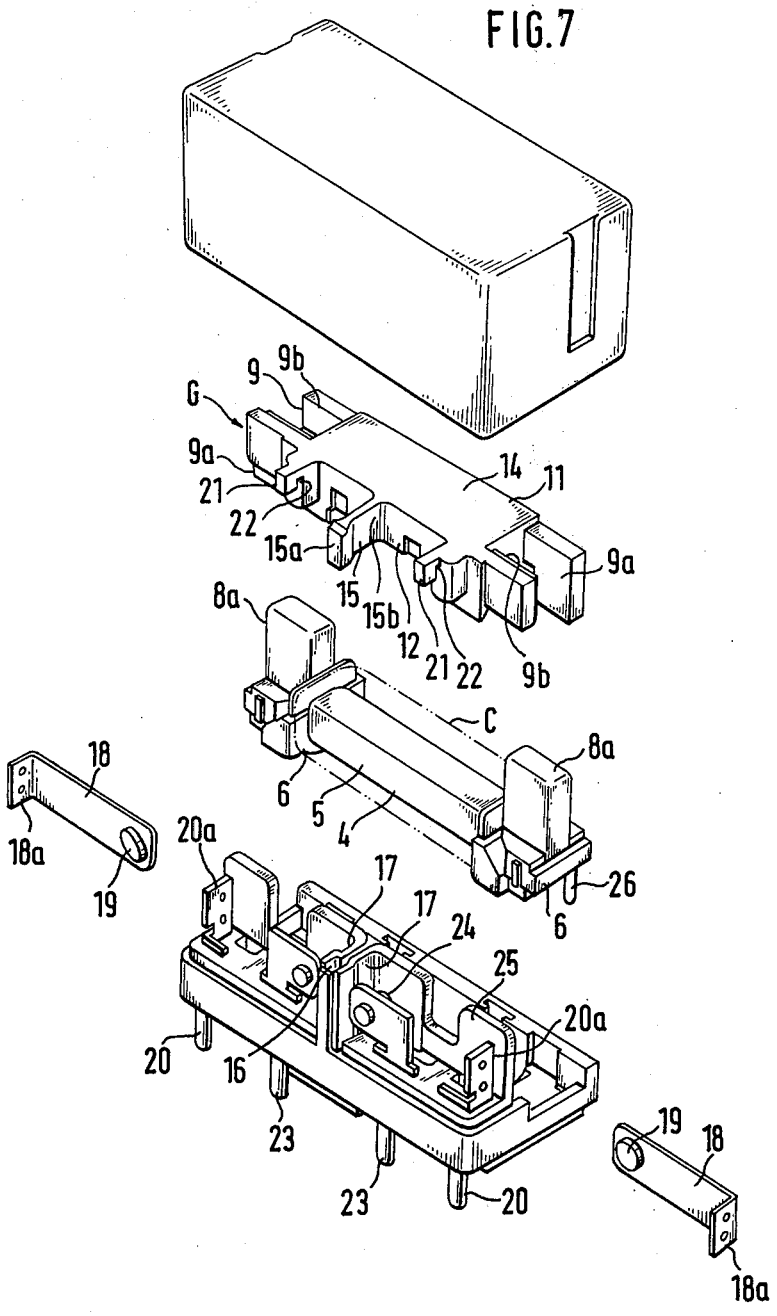
FIG. 7 is a perspective disassembled view.

Referring to the drawings which illustrate several preferred embodiments of this invention, the reference numeral 1 indicates a housing which consists of a relay base 2 made of an insulating material and a cover member 3. The insulating material is a synthetic resin in this example. The reference numeral 4 denotes a frame on which the coil C is wound, said frame comprising a coil-winding portion 5 and a pair of flanges 6, all integrally formed by resin molding. The coil-winding portion 5 of frame 4 has an internal cavity 7 through which a yoke 8 extends in such a manner that a pair of projecting ends 8*a* of the yoke 8 project upwards adjacent said flanges 6. The coil C, frame 4 and yoke 8, taken together, constitute an electromagnetic assembly M.

The reference numeral 9 denotes a pair of armatures which confront the projecting ends 8*a* of yoke 8 before and behind thereof, respectively, and have magnetic pole surfaces 9*a* and 9*b* which are adapted to contact said projecting ends 8*a*, one of said pole surfaces having a larger width than the other. A permanent magnet 10 is interposed between the armatures 9 for attracting the same, said permanent magnet 10 being shaped as a plate member.

An insulating frame 11 supports said armatures 9 and permanent magnet 10, and includes a top wall 12 along which one of the armatures 9 extends, a pair of posts 13 through which said one armature extends, and a horizontal wall 14 which, in cooperation with said posts 13, forms a permanent magnet cavity for accommodating and enclosing said permanent magnet 10, and a projecting wall 14*a* which extends from said horizontal wall 14 and, in cooperation with said wall 14, forms a permanent magnet positioning portion which accommodates the other armature and encloses it except the two pole surfaces 9*a* and 9*b* thereof, all of said wall members being formed integrally with said frame. The said one armature 9 piercing said posts 13 is made in the form of a thin plate so as to facilitate insertion and simultaneous molding.

Figure 10:
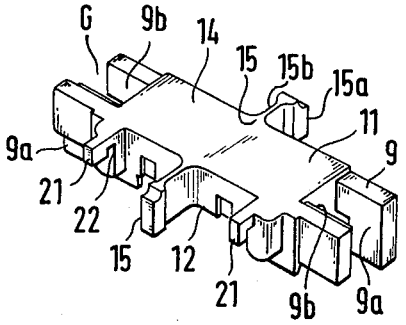
FIGS. 9 and 10 are perspective views of different embodiments.
Figure 8:
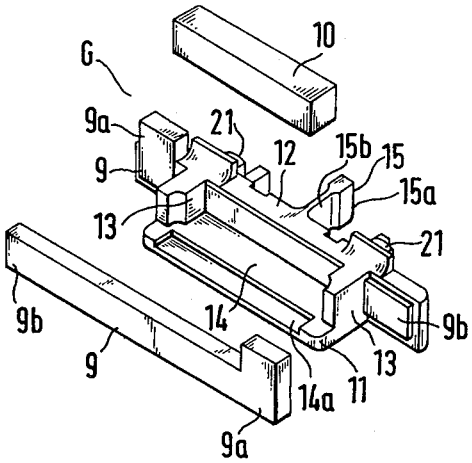
FIG. 8 is a perspective disassembled view of principal parts.

The insulation frame 11 further has as centrally projecting therefrom a resilient arm 15 which is capable of flexing in the direction T perpendicular to the rotational direction R of said armatures 9 (FIG. 12). Referring to FIGS. 1, 6, 7 and 10, the insulation from 11 is molded from a flexible synthetic resin material having a high arc resistance, said resilient arm 15 being integrally formed of the same material. In the embodiment illustrated in FIG. 11, the arm 15 is formed with a metal plate spring as embedded integrally therein but independently of the insulation frame 11. Therefore, the term "integral formation" or equivalent is used herein with reference to an integral action without the rattling or looseness which is inevitable to the round shaft-hole system mentioned hereinbefore. Further, the arm 15 may be constructed to project on both sides as illustrated in FIGS. 10 and 11. And even a rigid synthetic resin material may be employed as long as a sufficient resiliency can be assured by the thickness or shape of the arm 15. Such changes and substitutions may be freely made by those skilled in the art without departing from the scope of this invention. The two armatures 9, permanent magnet 10, insulation frame 11 and resilient arm 15, taken together, constitute an armature block G.

The base 2 is provided with a bearing portion 16.

For improved resiliency, said resilient arm 15 is formed to have a reduced thickness at its base portion 15*b* near the insulation frame 11 and an increased thickness at its forward end portion 15*a* in such a manner that a clearance 16*a* is provided at the base portion 15*b*, with the forward end portion 15*a* comprising a pair of side walls 17 which are firmly secured in position.

Designated by the reference numeral 18 are movable contact blades disposed on both sides of said resilient arm 15, each of said blades facing the top wall 12 of the insulation frame 11 of the armature block. Each movable contact blade 18 is provided with a movable contact 19 at its forward end, with its L-shaped base member 18 being fixedly secured to an L-shaped base member 20*a* of an L-shaped output terminal plate 20. The movable contact blade 18 engages an inner surface 22 of the crank formation of a card 21 for forced release. The reference numeral 23 indicates an input terminal plate bearing a stationary contact 24, and the two contacts 18 and 24 form a contact assembly S.

The base 2 has an upright partitioning wall 25 as disposed between this contact assembly S on the one hand and said electromagnet segment M and armature block G on the other hand to provide an arc shield. The partitioning wall 25 is formed integrally with the side walls 17 of said bearing portion 16. A terminal plate 26 for exciting said coil C is configured in the shape of a capital letter L, with its horizontal member 26*a* passing through the flange 6 of frame 4. The terminal plates 20, 23 and 26 extend through the base 2.

FIG. 15 is a schematic view showing a further improved embodiment of this invention which ensures a better agreement between spring load and attraction force characteristics. Thus, one of two contacts, which is indicated at 27, is a flexure contact which is released from abutment against a stationary contact 28 under no load and the other contact spring 29 forms a lift-off contact which comes into abutment against the stationary contact under no load. The contact spring 29 forming said lift-off contact carries a movable contact 31 on one side thereof which lies closer to armature 30, and an auxiliary spring 32 is attached to the same movable contact terminal plate 33, said auxiliary spring 32 being abutted against the side of contact spring 29 which is opposite to the first mentioned side carrying the movable contact 31. The free end of auxiliary spring 32 is not held in abutment against contact spring 29 at all times but comes into abutment only after the contact spring 29 is compressed away from stationary contact 28, thereby augmenting the spring load of the three vector spring loads of said flexure contact, lift-off contact and auxiliary spring member assumes an increased value toward the end of the armature stroke on the off side of the contact until the spring load value on the off side is equal to the spring load value on the on side. In this manner, the overall spring load characteristic is lined up with the attraction force characteristic of the electromagnetic relay.

Figure 9:
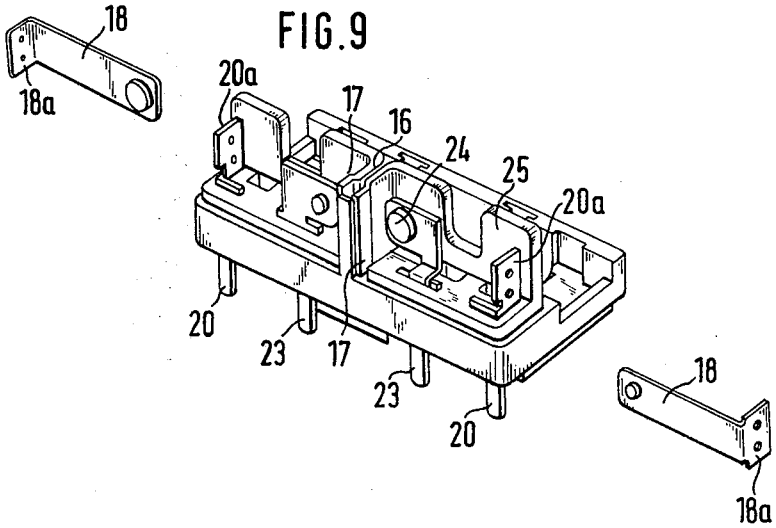

The mode of operation of the electromagnetic relay according to this invention will now be described. Refering to FIGS. 13*a* and 13*b* which show an arrangement wherein one contact is normally open and the other normally closed (with FIG. 13*a* representing the rest position and FIG. 13*b* the active position of the relay), the armature block G is driven about resilient arm 15 as the coil is energized, whereby the contact assemblies S on both sides are alternately opened and closed. In FIGS. 14*a* and 14*b* which show another arrangement in which both contacts are normally open (FIG. 14*a* showing the rest position and FIG. 14*b* the active position of the relay), the rotation of armature block G results in a simultaneous opening or closing of the two contact assemblies on both sides. The construction represented by FIGS. 13*a* and 13*b* corresponds to the one depicted in FIG. 7 and the contruction represented by FIGS. 14*a* and 14*b* corresponds to the one depicted in FIG. 9.

The relationship between the armature block G and the resilient arm 15 is that the arm 15 is fixed in the direction T perpendicular to the rotational direction R of armature block G in response to the rotation thereof as shown in FIG. 12. Therefore, if the axis of rotation is offset, there is a following movement to the right or left or to fore or aft within the range of flexure to cancel out the amount of offset, thus eliminating the problem of rattling or looseness about the axis of rotation.

Since the electromagnetic relay according to this invention is such that the insulation frame 11 supporting said armatures 9 and permanent magnet 10 has as integrally formed therewith the resilient arm 15 capable of flexing in a direction perpendicular to the rotational axis of armatures 9, with said resilient arm being securely supported by the bearing portion 16 of base 2, any offset due to a flexure of the resilient arm 15 is cancelled out by said following movement. This arrangement eliminates the need of exercising the great care for centering which has heretofore been required in the conventional shaft-hole system. Furthermore, since the armature G is a one-piece assembly comprising said armatures 9, permanent magnet 10 and insulation frame 11, the final assembling operation is rendered more efficient than is the case with the prior art electromagnetic relay which my be assembled only by building said parts one by one into its housing.

In addition to the features described hereinbefore, the electromagnetic relay of this invention is further characterized in that its base 2 is provided with said upright partitioning wall 25 to provide an effective shield against arcing between contacts. Moreover, the movable contact blade 18 is adapted to engage the inner surface 22 of the crank formation of the card 21, and the insulation frame 11 supporting said armatures 9 and permanent magnet 10 is provided with the top wall 12 along which one of said armatures is disposed, the pair of posts 13 through which said one armature extends, the horizontal wall 14 which, in cooperation with said posts 13, defines a permanent magnet cavity for accommodating and enclosing said permanent magnet 10 and the extending wall 14*a* which extends from said horizontal wall 14 and, taken together therewith, forms a permanent magnet positioning segment which accommodates the other armature 9 and covers it with its pole faces 9*a* and 9*b* alone left exposed, all of said wall members being integrally formed with said frame.

In addition, one of said two contact springs carries a flexure contact while the other contact spring supports a lift-off contact, the former contact spring being provided with an auxiliary spring which abuts against a face of the contact spring which is opposite to the face bearing said movable contact. By these members and features, the objects mentioned at the outset are accomplished.

In the rotary armature relay shown in FIG. 16, the armature includes a permanent magnet and is pivoted on one side in a bearing block 16 by means of a flexible web or resilient arm 15. The web 15 is integrally formed with an insulating envelope or frame 11 of the armature, just as are the actuator portions 21*a*, 21*b*, 21*a*', 21*b*'. The insulating envelope also serves to fasten at least one permanent magnet (not shown) and armatures 9, the pole shoes cooperating with pole ends 8*a* of a coil core. The actuator portions 21*a*, 21*b* and 21*a*', 21*b*' shown in cross-section are connected to each other at their upper sides and thus straddle the contact springs 18 and 18'.

In the position shown in FIG. 16, the right-hand contact couple 19, 24 is closed and the left-hand contact couple 19', 24' is open. In the closed position, the rounded surface of the actuator portion 21*b* presses against the contact spring 18, while the opposite actuator portion 21*a* is spaced from the spring. In accordance with the relatively great spring length L2, the contact spring 18 is thereby substantially bent. On the other hand, the open position of the left-hand contact couple 19', 24' is achieved by the effect of the actuator portion 21*a*' engaging the contact spring 18', whereas the actuator portion 21*b*' is spaced from the spring 18'. At the beginning of the opening process, the corner 21*c*, 21*c*' on the side of the respective actuator portion 21*a*, 21*a*' facing the contact engages the respective contact spring 18, 18', so that the short spring length L3, L'3 between the corner and the contact location is effective. When the opening movement proceeds, the location at which the actuator portion 21*a*, 21*a*' engages the respective contact spring moves along the contact spring, because the surface of the actuator portion facing the contact spring extends parallel to the longitudinal axis of the armature from the corner 21*c*′ of the actuator portion facing the contact to the corner 21*d*′ remote from the contact.

This embodiment guarantees that the contact closing is done through the large spring lengths L2, L′2 while the contact opening is performed forcibly by the short, thus stiff lengths L3, L′3. In addition to the advantages present in the previously described embodiments, the present embodiment has the further benefit of a larger contact spacing as a result of the point of engagement of the actuator portion 21*a*′ travelling from the corner 21*c*′ facing the contact to the corner 21*d*′ remote from the contact.

Due to the large spring excursion in the contact closing, a large proportion of the permanent-magnetic pull is stored in the contact springs 18 or 18′, respectively. On the other hand, the small resiliency of the contact springs in the contact opening will tend to tear apart any contact couple that may have become welded, in which case the other contact couple is properly actuated; otherwise, when the welded contact couple cannot be torn open, operation of the other contact couple will be prevented.

We claim:

1. An electromagnetic relay comprising (a) an armature block including a pair of armatures and a permanent magnet supported therebetween to magnetize the armatures to opposed polarities, each armature having a portion in contact with said permanent magnet and ends extending beyond said portions, (b) a pair of relay contacts operated by said armature block, (c) a bracket-shaped yoke having projecting ends each disposed in an air gap between the corresponding ends of said armatures, (d) an exciting coil connected to a power supply for energizing said yoke, and (e) a resilient arm supporting said armature block in such a manner that said block may be rotated selectively toward said projecting ends of said yoke, said resilient arm extending from said block in a direction perpendicular to the axis of rotation of said armature block and being secured at its outer end.

2. An electromagnetic relay according to claim 1, wherein one of said armatures is integrally formed with a base of plastic molding material, said base including, as integrally formed, a pair of cards adapted to drive a pair of contact springs each bearing a contact, said resilient arm and a cavity for accommodating said permanent magnet, with the other armature being positioned in abutment against, and rigidly secured to, said permanent magnet in said cavity.

3. An electromagnetic relay according to claim 2, wherein each of said cards has, as integrally formed therewith, a pressing surface for pressing said contact spring and a crank portion adapted to retain the corresponding contact in forced release by engaging the face of said contact spring which lies on the side opposite to said pressing surface.

4. An electromagnetic relay according to claim 2, wherein said pair of relay contacts are integrally molded in said plastic base and independently accommodated in a pair of compartments which are defined by said base and a stationary portion for securing the other end of said resilient arm.

5. An electromagnetic relay according to claim 4, wherein one of said pair of contacts is supported by a lift-off contact spring which is provided with an auxiliary spring adapted to abut against a stationary member immediately before a release of the contact to augment the spring force of said contact spring.

6. An electromagnetic relay according to claim 1, wherein said armature block has an actuating member for each contact spring, each actuating member straddling the corresponding spring and having a pressing surface at its side remote from the contact to close the same and a bent portion at its other side facing the contact for forcibly opening the same, the pressing surface being disposed further remote from the contact position than the bent portion.

7. An electromagnetic relay according to claim 6, wherein said bent portion effecting the contact opening has a first section located closer to the contact and a second section located more remote from the contact, the contact opening being initiated by said first section, and the point of engagement with the contact spring travelling from said first to said second section during the contact opening movement.

* * * * *